US010119502B2

(12) United States Patent
Madeira

(10) Patent No.: US 10,119,502 B2
(45) Date of Patent: Nov. 6, 2018

(54) INTAKE MODULE OF AN AIR INTAKE TRACT OF AN INTERNAL COMBUSTION ENGINE

(71) Applicant: MANN+HUMMEL GMBH, Ludwigsburg (DE)

(72) Inventor: Pedro Miguel Pereira Madeira, Bietigheim-Bissingen (DE)

(73) Assignee: MANN+HUMMEL GmbH, Ludwigsburg (DE)

( * ) Notice: Subject to any disclaimer, the term of this patent is extended or adjusted under 35 U.S.C. 154(b) by 0 days.

(21) Appl. No.: 14/731,558

(22) Filed: Jun. 5, 2015

(65) Prior Publication Data

US 2015/0267655 A1 Sep. 24, 2015

Related U.S. Application Data

(63) Continuation of application No. PCT/EP2013/075596, filed on Dec. 5, 2013.

(30) Foreign Application Priority Data

Dec. 6, 2012 (DE) ..... 10 2012 023 856

(51) Int. Cl.
*F02M 35/10* (2006.01)
*F02M 35/024* (2006.01)
(Continued)

(52) U.S. Cl.
CPC .. *F02M 35/10078* (2013.01); *F02M 35/0201* (2013.01); *F02M 35/024* (2013.01);
(Continued)

(58) Field of Classification Search
CPC ..... F02M 35/10078; F02M 35/10013; F02M 35/0201; F02M 35/024; F02M 35/164;
(Continued)

(56) References Cited

U.S. PATENT DOCUMENTS 3,641,744 A * 2/1972 Culbert ..... B01D 45/16 55/319
4,013,137 A 3/1977 Peterson
(Continued)

FOREIGN PATENT DOCUMENTS

DE 7902819 U1 6/1979
DE 10200100 A1 8/2003
(Continued)

*Primary Examiner* — Joseph Dallo
*Assistant Examiner* — Scott A Reinbold
(74) *Attorney, Agent, or Firm* — James Hasselbeck

(57) ABSTRACT

An intake module of an air intake tract of an internal combustion engine is provided with an intake housing part that has at least one inlet for combustion air to be filtered and an outlet section. A filter housing part with an air filter element that filters the combustion air is provided. The filter housing part has an inlet section and at least one outlet for the filtered combustion air. An air connection between the outlet section of the intake housing part and an inflow side of the air filter element is provided. A fixed intake pipe part is arranged between the outlet section of the intake housing part and the inlet section of the filter housing part. The fixed intake pipe part at least partially forms the air connection between the outlet section of the intake housing part and the inflow side of the air filter element.

11 Claims, 5 Drawing Sheets

(51) Int. Cl.
*F02M 35/02* (2006.01)
*F02M 35/16* (2006.01)

(52) U.S. Cl.
CPC .. *F02M 35/0216* (2013.01); *F02M 35/10013* (2013.01); *F02M 35/164* (2013.01)

(58) Field of Classification Search
CPC ..... F02M 35/0216; F02M 35/10144; B01D 2279/60; B01D 46/10
See application file for complete search history.

(56) References Cited

U.S. PATENT DOCUMENTS 4,131,441 A 12/1978 Randall
4,157,902 A 6/1979 Tokar
4,366,878 A * 1/1983 Warf ..... B60K 13/02 180/68.3
4,699,639 A * 10/1987 Gieseke ..... F02M 35/022 55/385.3
5,034,036 A 7/1991 Creek et al.
7,637,978 B2 * 12/2009 Jung ..... F02M 35/022 55/396
2005/0274347 A1 * 12/2005 Cusumano ..... F02M 35/022 123/184.21
2009/0320686 A1 * 12/2009 Blossey ..... B01D 46/0004 96/188

FOREIGN PATENT DOCUMENTS

DE 102008061538 A1 6/2010
EP 1249597 A1 10/2002
GB 2055719 A 3/1981
JP 09144615 A 6/1997
WO 2005107924 A2 11/2005
WO 2011094334 A1 8/2011
WO WO 2011094334 A1 * 8/2011 ..... F02M 35/088

* cited by examiner

INTAKE MODULE OF AN AIR INTAKE TRACT OF AN INTERNAL COMBUSTION ENGINE

CROSS-REFERENCE TO RELATED APPLICATIONS

This application is a continuation application of international application No. PCT/EP2013/075596 having an international filing date of 5 Dec. 2013 and designating the United States, the International Application claiming a priority date of 6 Dec. 2012, based on prior filed German patent application No. 10 2012 023 856.8, the entire contents of the aforesaid international application and the aforesaid German patent application being incorporated herein by reference.

BACKGROUND OF THE INVENTION

The invention concerns an intake module of an air intake tract of an internal combustion engine of a motor vehicle, in particular of a commercial vehicle, comprising a filter housing part in which an air filter element for filtration of sucked-in combustion air is arranged and that comprises at least one outlet for purified combustion air, and comprising an intake housing part that comprises at least one inlet for the combustion air to be purified, and comprising an air connection between an outlet section of the intake housing part and an inflow side of the air filter element.

WO 2005/107924 A2 discloses an air filter for purification of combustion air of an internal combustion engine of a vehicle. The air filter comprises a filter element. It is arranged in an air inlet stream of the internal combustion engine. The air filter comprises a housing with an inlet end, an inlet section with a prefilter section, a main section, and an outlet section. The inlet section is attached to the main section. The outlet section is also attached to the main section. The inlet section is arranged immediately on the main section of the housing. The filter element is located in the main section. The housing as a whole is of a linear configuration, i.e., the inlet section, the main section, and the outlet section are arranged linearly behind each other.

SUMMARY OF THE INVENTION

The invention has the object to design an intake module of the aforementioned kind that can be arranged in a space-saving and flexible way on or in the motor vehicle.

This object is solved according to the invention in that between the outlet section of the intake housing part and an inlet section of the filter housing part a fixed intake pipe part is arranged which forms at least partially the air connection between the outlet section of the intake housing part and the inflow side of the air filter element.

By interposition of the fixed, i.e., non-flexible, intake pipe part between the intake housing part and the filter housing part, the two housing parts can be arranged at a spacing relative to each other. In contrast to the air filter known from the prior art, according to the invention it is not required to arrange the intake housing part immediately adjacent to the filter housing part. The intake location which is defined by the inlet of the intake housing part can thus be selected more freely. Accordingly, the intake module can be arranged, for example, at a location in an upper area of the motor vehicle, in particular in the area of a roof. Here, generally a proportion of particles, in particular dust particles, and/or water in the ambient air is lower compared to immediately above a road surface. Accordingly, an introduction of particles and/or water into the intake module can be reduced in a simple way.

Advantageously, the intake housing part, the filter housing part, and the intake pipe part can be pre-manufactured separate from each other as modular components. The modular housing parts can then be combined as needed, in particular as a function of the intended use and/or a location of use of the motor vehicle. Alternatively, at least two of the housing parts can be monolithically connected to each other. In this way, the monolithic housing parts can be produced together. The intake housing part, the filter housing part and/or the intake pipe part can be comprised of plastic material. The intake housing part, the filter housing part and/or the intake pipe part can be advantageously produced by means of a blow-molding method and/or an injection-molding method. In this way, a monolithic modular housing can be realized also in a simple way.

Advantageously, the intake module can be pre-manufactured and can be attached as a whole in particular on an appropriate frame part of the motor vehicle. In this way, the expenditure in regard to corresponding fastening means can be reduced.

Advantageously, the outlet of the filter housing part can be connected by means of a further air connection with the internal combustion engine. The air connection advantageously can be a flexible, in particular bendable and/or expandable, hose or an appropriate pipe. In this way, the intake module can be moved relative to the internal combustion engine within limits that are predetermined by the flexible hose or the flexible pipe. Accordingly, the location of attachment for the intake module can be selected more independently relative to the internal combustion engine.

Advantageously, the intake module can be arranged on a driver's cabin of a truck. Preferably, the intake module can be arranged behind a back side of the driver's cabin that is rearward relative to the normal travel direction. In this way, the required space for the intake tract below the driver's cabin can be reduced. The internal combustion engine can advantageously be arranged below the driver's cabin and can be connected with a chassis of the truck. The intake module can be connected by means of the further air connection, in particular of the flexible hose or pipe, with the internal combustion engine. The flexible hose or the flexible pipe can compensate movements of the driver's cabin relative to the chassis.

Advantageously, the intake module can be attached to a fastening device, in particular a bracket. The fastening device can advantageously be connected to the chassis. In this way, the intake module can be attached on the chassis flexibly and separate from the driver's cabin. Alternatively or additionally, the fastening device can be connected to the driver's cabin.

Advantageously, the air filter element can be arranged exchangeably in the filter housing part. The filter housing part is openable for this purpose. In this way, the air filter element can be removed from the filter housing part, in particular for servicing purposes or for cleaning purposes.

In an advantageous embodiment, the filter housing part and the intake housing part can be arranged displaced relative to each other. In this way, the outer dimensions of the intake module can be designed more flexibly. A ratio of expansion of the expansion of the intake module in a longitudinal direction and in a transverse direction can thus be matched optimally to a mounting space that is available in or on the motor vehicle. Advantageously, the filter housing part and the intake housing part can have a common center plane. In this way, the expansion of the intake module in a direction perpendicular to the center plane can be reduced. The intake module as a whole can be designed to be more flat.

Advantageously, in the mounted state of the intake module, the intake housing part can be arranged spatially above the filter housing part. The intake housing part can be arranged by appropriate selection of the length of the intake pipe part as high as possible on the motor vehicle and remote from the filter housing part.

Advantageously, a main flow direction of the combustion air to be purified in an inlet section of the intake housing part can extend approximately parallel to a main flow direction of the combustion air to be filtered in an inlet section of the filter housing part. Advantageously, the main flow path in the intake module as a whole can extend Z-shaped. Due to the Z-shaped course of the main flow path, the air can be laterally sucked in, guided downwardly, and introduced into the displaced filter housing part with the air filter element. Advantageously, between the outlet section of the intake housing part and the intake pipe part, a 90 degree deflection of the main flow direction of the combustion air can be realized. Accordingly, the laterally sucked-in combustion air, behind the deflection, can be conveyed directly downwardly to the intake housing part. Advantageously, a 90 degree deflection of the main flow direction can be realized between a downstream end of the intake pipe part and the main flow direction of the combustion air to be filtered in the inlet section of the filter housing. Downstream of the 90 degree deflection, the air can be guided to the inflow side of the air filter element. The air filter element can thus be arranged horizontally in a space-saving way. Due to the 90 degree deflection, a separation of particles and/or water contained possibly in the combustion air can be improved also.

In a further advantageous embodiment, a flow cross-section in the intake housing part can decrease in the main flow direction. In this way, a larger inlet opening can be realized. Accordingly, the risk of blockage of the inlet opening, in particular by dirt, snow, ice or water, can be reduced. By reducing the flow cross-section, in a simple way an increase of the flow velocity in the main flow direction can be achieved. Also, in particular the flow course can be improved and/or the noise emission when taking in the combustion air can be reduced. Moreover, the cross-section of the air flow can thus be adjusted to the inner cross-section of the intake pipe part. Advantageously, the inner cross-section of the intake housing part can decrease funnel-like at least in one cross-sectional direction.

In a further advantageous embodiment, at least one water separating device can be arranged upstream of the inflow side of the air filter element. By means of the water separating device, water that is possibly entrained by the sucked-in combustion air can be separated before it can reach the air filter element. In this way, loading of the air filter element with water can be reduced. The filter efficiency can thus be improved. Moreover, the service life of the air filter element can be extended.

In a further advantageous embodiment, an inlet grid can be arranged on or in the inlet of the intake housing part in the flow path of the sucked-in combustion air. The inlet grid can act as kind of a pre-filter. With the inlet grid, depending on its inlet holes, larger particles and/or water can be separated from the sucked-in ambient air before they can reach the intake housing part. Advantageously, the inlet grid may comprise water-repellent properties. In this way, water that is possibly contained in the ambient air, in particular in form of droplets, can be retained at the upstream side of the inlet grid. The inlet grid can advantageously be comprised of a water-repellent material, in particular plastic material. Advantageously, the inlet grid can be separably connected, in particular by means of a locking connection, with the intake housing part. In this way, the inlet grid, in particular for servicing purposes or cleaning purposes, can thus be separated from the intake housing part. The interior of the intake housing part, when the inlet grid is removed, can be accessible through the inlet opening.

In a further advantageous embodiment, in the intake housing part at least one water separating surface can be arranged. On the at least one water separating surface, water that is entrained by the combustion air can be separated. In this way, the water separation action can be further improved. Advantageously, a plurality of water separating walls can be arranged in the intake housing part. The water separating walls can advantageously extend parallel to each other. Advantageously, they can extend in the main flow direction of the combustion air. By means of the water separating walls, a surface area that is active for water separation can be further enlarged and, in this way, the water separation action can be improved. The at least one water separating surface can advantageously be arranged upstream of a possible first deflection between the intake housing part and the intake pipe part. In this way, a water proportion which may reach the intake pipe part together with the combustion air can be further reduced.

In a further advantageous embodiment, at least one water separating surface can be arranged in the intake pipe part. The at least one water separating surface in the intake pipe part can be provided additionally or alternatively to at least one water separating surface optionally present in the intake housing part. A water separation action of water that is entrained with the combustion air can be realized additionally in the intake pipe part in this way. Accordingly, the water separation can be further improved.

The at least one water separating surface can be connected advantageously fixedly with the intake pipe part. Advantageously, the intake pipe part can be pre-manufactured together with the at least one water separating surface. Alternatively, the at least one water separating surface can be separably connected, in particular by means of a locking connection, with the intake pipe part. It can thus be removed for servicing purposes and/or for cleaning purposes from the intake pipe part. In this way, an optional arrangement of the water separating surface can be adapted also to an intended use and/or location of use of the motor vehicle, as needed.

Advantageously, the at least one water separating surface can be realized as a baffle collar. Advantageously, the baffle collar can be arranged preferably coaxially within the intake pipe part. A separation space that is delimited radially inwardly by the baffle collar and radially outwardly by the circumferential wall of the intake pipe part can advantageously be open at an upstream end face. By means of the baffle collar, the flow course of the combustion air can be changed such that entrained water and/or water droplets can be separated from, so to speak "peeled off", the main stream of the combustion air. The separated water can then advantageously be collected in the separation space radially outside of the baffle collar and removed from the intake pipe part.

In a further advantageous embodiment, at least one particle separating device can be arranged fluidically between the inlet of the intake housing part and the inflow side of the air filter element. By means of the particle separating device, particles that are possibly entrained by the sucked-in combustion air can be separated. In this way, a quantity of particles that reach the air filter element can be reduced. In this way, the service life of the air filter element can be further extended. The particle separating device can thus act as a pre-stage for purifying the combustion air.

Advantageously, the particle separating device may comprise at least one cyclone separator. By means of a cyclone separator, in a simple way an efficient particle separation can be realized. Also, in case of a cyclone separator a pressure loss between the inflow side and the outflow side can be minimized. The cyclone separator can comprise advantageously a plurality of separator vanes. The particles can be better separated on separator vanes.

The particle separating device may comprise a sleeve-shaped housing part in which the elements active for particle separation, in particular separator vanes, can be arranged. The sleeve-shaped housing part can advantageously be arranged upstream of, downstream of, or within the intake pipe part. The sleeve-shaped housing part of the particle separating device can advantageously make the intake pipe part longer and, accordingly, can form it partially, so to speak. The elements active for particle separation can also be directly arranged in the intake pipe part, i.e., without sleeve-shaped housing part.

In the intake pipe part, the flow cross-section for the sucked-in combustion air can be smaller than in the intake housing part. In this way, the flow velocity through the particle separating device, in particular the cyclone separator, can be increased. In this way, the separating efficiency can be further improved.

The at least one particle separating device, in particular the elements active for particle separation and/or the sleeve-shaped housing part, can advantageously be connected separably, in particular by means of a locking connection, with the intake pipe part. In this way, the particle separating device for servicing purposes and/or for cleaning purposes can be separated simply from the intake pipe part. Also, in this way, the intake module can be furnished optionally with the particle separating device. Accordingly, the intake module can be furnished, depending on the field of application and/or intended use of the motor vehicle, with a particle separating device in accordance with demands.

In a further advantageous embodiment, between the inlet of the intake housing part and the inflow side of the air filter element, at least one drainage device for separated media, e.g. separated particles and/or separated water, can be arranged. By means of the at least one drainage device, the separated particles and/or the separated water can be drained simply from the intake module. This can be realized during operation of the internal combustion engine. Drainage can be done automatically and/or manually.

Advantageously, the drainage device can be connected to a collecting area within the intake module for separated particles and/or separated water.

The at least one drainage device can advantageously comprise a drain valve. The drain valve can be opened as needed. Drainage via the drain valve can advantageously be realized depending on the quantity of the separated particles and/or of the separated water. The drain valve can be a type of non-return valve. In this way, it can be prevented that the leak air can be sucked in through the at least one drainage device into the intake module. The drain valve can advantageously be connected to a control unit so as to be controllable. Advantageously, a water level sensor can be provided with which the quantity of separated water can be detected. The water level sensor can advantageously be connected in terms of signaling action and/or control action with the drain valve and/or a possible control unit.

The at least one drainage device can advantageously be connected separably with the intake pipe part or the filter housing part. In this way, the at least one drainage device can be arranged modularly on the intake module. The intake module can thus be adapted even better to the intended use and/or location of use.

Advantageously, the at least one drainage device can be arranged downstream of optionally the at least one separating device and/or the at least one particle separating device. Advantageously, the at least one drainage device, in the mounted state of the intake module, can be arranged spatially below the at least one water separating device and/or the at least one particle separating device. In this way, the separated particles and/or the separated water, following the force of gravity, can migrate downwardly, collect optionally in a collecting chamber, and be optionally removed by means of the at least one drainage device from the intake module.

In a further advantageous embodiment, the filter housing part and/or the intake housing part can be of a flat configuration. In this way, the intake module can be arranged in a space-saving way in particular on a wall or in an intermediate space of the motor vehicle. Advantageously, the intake module can thus be arranged in a simple and space-saving way at a vertical back side of a driver's cabin of the truck. Flat in the meaning of the invention means that an expansion of a cross-section of the filter housing part or of the intake housing part in one direction is substantially smaller than in another direction that is perpendicular to the first mentioned direction. Advantageously, the expansion of a short side of the filter housing part or of the intake housing part can be less than approximately half, preferably less than approximately one third, of the expansion of a long side. Advantageously, the filter housing part and/or the intake housing part can have a flat-oval cross-section.

Advantageously, the air filter element can be an oval, in particular flat-oval, annular filter element. By means of an annular filter element, a large surface area active for filtration and to be flowed through by the combustion air can be realized relative to its outer volume. An annular filter element can be flowed through simply in radial direction from the exterior to the interior or vice versa by the combustion air to be filtered. The annular filter element can advantageously comprise a zigzag-shaped folded, circumferentially closed filter medium. Due to the zigzag-shaped folding action, the surface area of the filter element active for filtration can be further enlarged.

BRIEF DESCRIPTION OF THE DRAWINGS

Further advantages, features, and details of the invention result from the following description in which an embodiment of the invention will be explained in more detail with the aid of the drawing. A person of skill in the art will consider the features disclosed in combination in the drawing, the description, and the claims also individually and combine them to other meaningful combinations.

In the Figures, same components are provided with same reference characters.

DESCRIPTION OF PREFERRED EMBODIMENTS

Figure 1:
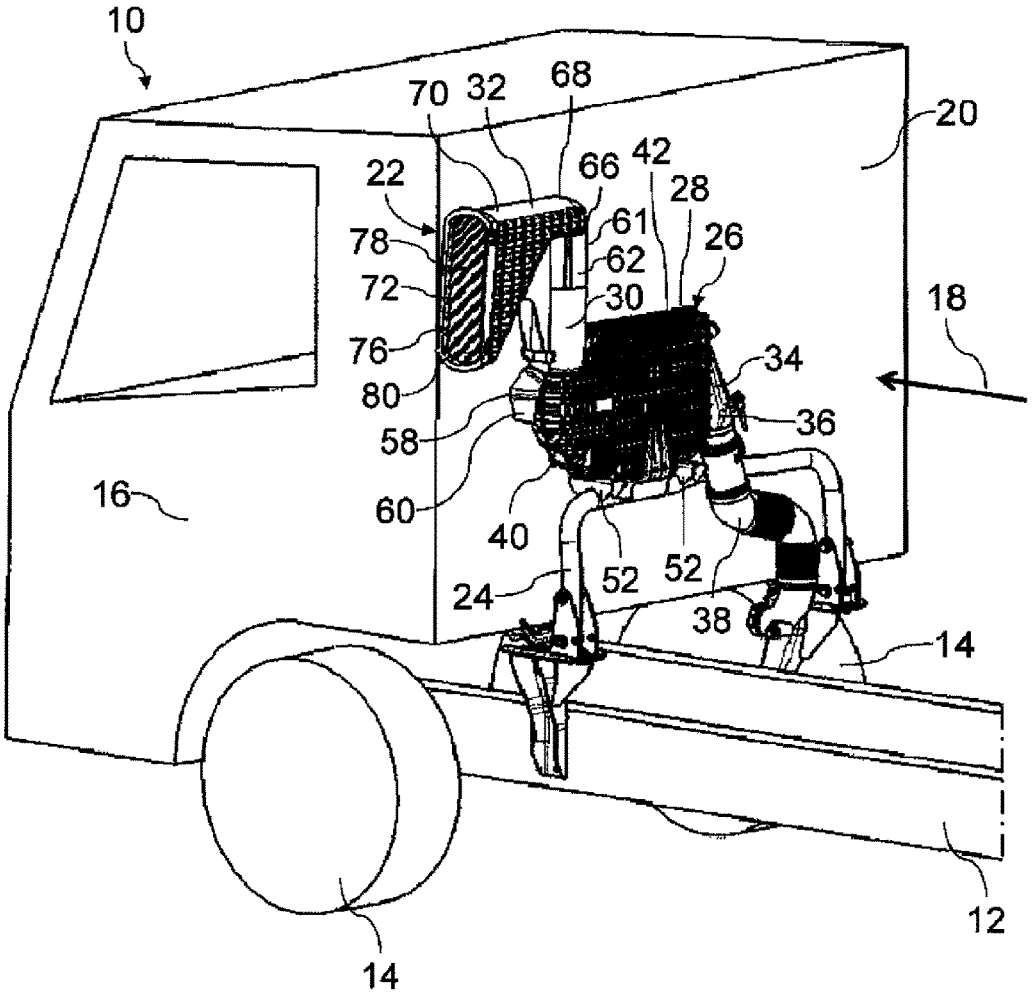
FIG. 1 shows schematically a detail of a truck in the area of the driver's cabin having at its back side an intake module of an air intake tract of an internal combustion engine of the truck.

In FIG. 1 a detail of a truck 10 is illustrated. The truck 10 comprises a chassis 12 to which an internal combustion engine, not illustrated; a drive train, also not illustrated; and wheels 14 are attached. In the detail of FIG. 1, the front wheels 14 are shown in an exemplary fashion. Above the front wheels 14, a driver's cabin 16 is arranged that is mounted on the chassis 12. Below the driver's cabin 16 the internal combustion engine is arranged.

Figure 2:
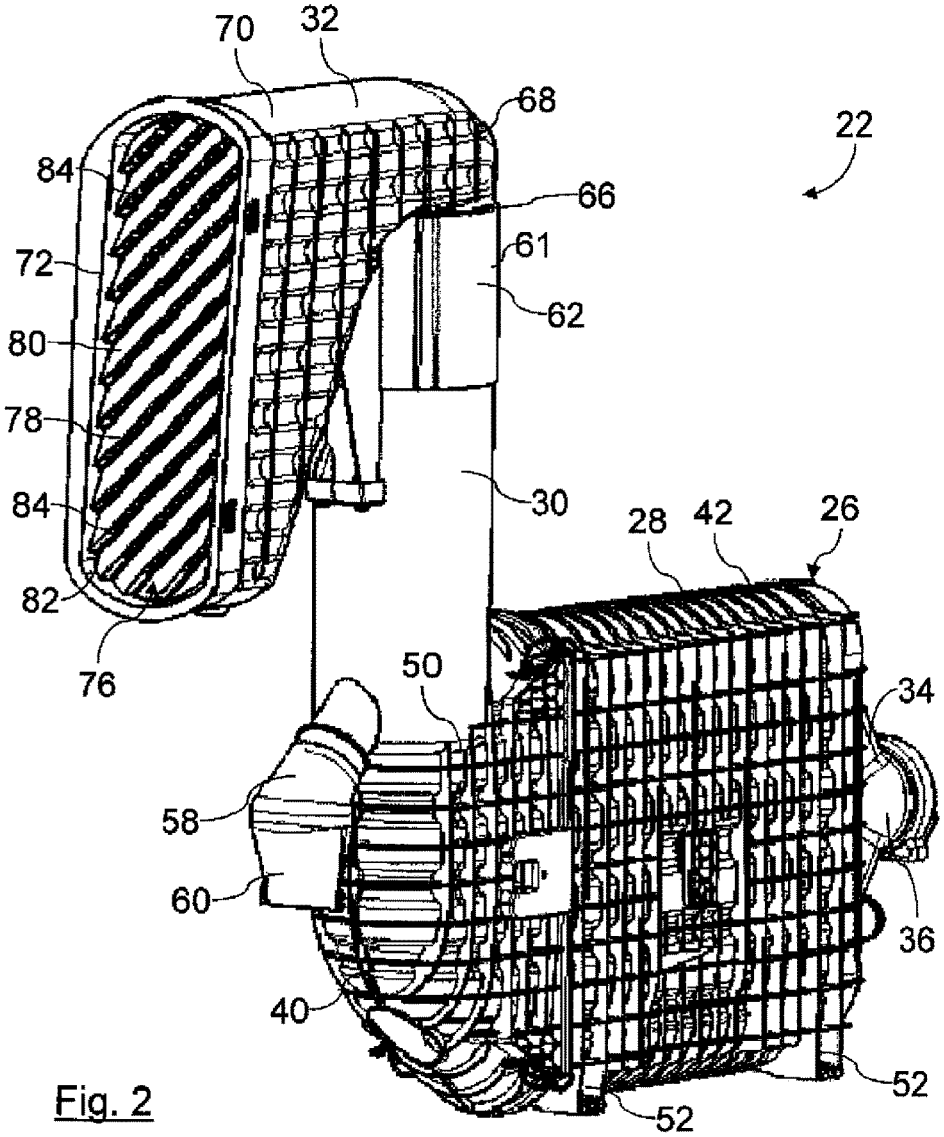
FIG. 2 shows a detail view of the intake module of FIG. 1 in a perspective view.
Figure 3:
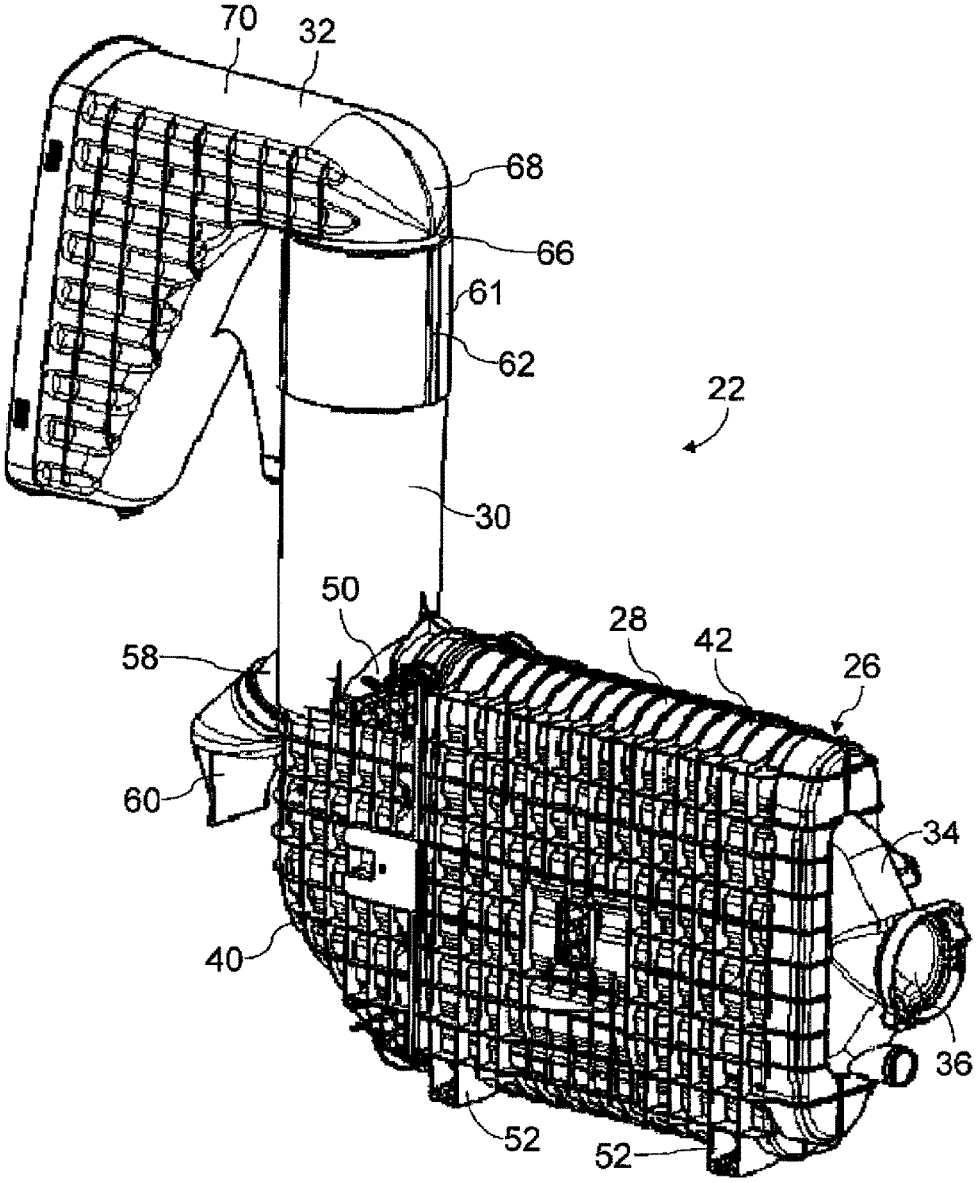
FIG. 3 shows a detail view of the intake module of FIG. 1 in another perspective view.
Figure 4:
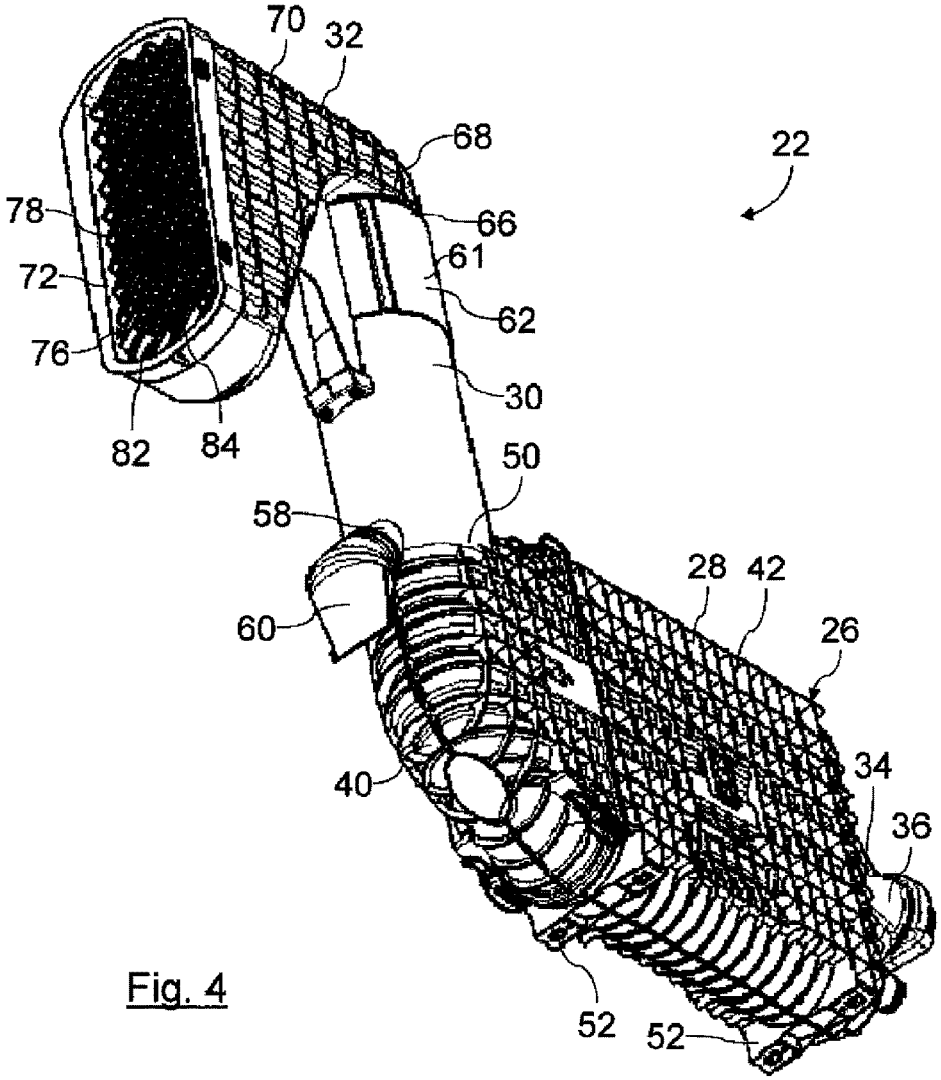
FIG. 4 shows a detail view of the intake module of FIG. 1 in yet another perspective view.

In the travel direction of the truck 10, in FIG. 1 indicated by arrow 18, behind a vertical back wall 20 of the driver's cabin 16, an intake module 22 of an intake tract, not otherwise illustrated, of the internal combustion engine is arranged. The intake module 22 is shown in detail in FIGS. 2 to 4 and in longitudinal section in FIG. 5.

When "vertical", "horizontal", "top", and "bottom" are used in the description, this relates to, if not noted otherwise, the normal spatial arrangement of the truck 10, in particular of the intake module 22, on a horizontal road surface. The normal arrangement of the truck 10 is illustrated in FIGS. 1 to 5.

The intake module 22 is attached at the top of a bracket 24. The bracket 24 is secured with its legs by means of screw connections on the chassis 12. The intake module 22 comprises a module housing 26 which comprises a filter housing part 28, a fixed intake pipe part 30, and an intake housing part 32. The filter housing part 28, the intake pipe part 30, and the intake housing part 32 are separate modular components which can be combined as needed. They are each comprised of plastic material. Preferably, the housing parts 28, 30, 32 are produced by a blow-molding method.

The filter housing part 28 has a flat-oval cross-section. The length of the short transverse axis of the cross-section of the filter housing part 28 amounts to approximately one third of the length of the long transverse axis. The filter housing part 28 is oriented such that the long transverse axis is vertically oriented and the short transverse axis is extending horizontally, in the embodiment approximately perpendicular to the back wall 20 of the driver's cabin 16. As a whole, the flat filter housing 28 extends thus approximately parallel to the back wall 20.

The filter housing part 28 comprises an outlet 34 for combustion air to be filtered. The outlet 34 comprises an outlet socket 36 which is connected with a flexible connecting hose 38 that is shown in FIG. 1. The connecting hose 38 extends to an intake side of the internal combustion engine. By means of the flexible connecting hose 38 provided with bending folds, a relative movement between the intake module 22 and the internal combustion engine can be compensated. Such relative movements can be caused by vibrations, for example, during operation of the truck 10, in particular of the internal combustion engine. With the intake module 22, the combustion air for the internal combustion engine is sucked in from the environment and purified. The purified combustion air is supplied via the connecting hose 38 to the internal combustion engine.

The filter housing part 28 has moreover an inlet deflection housing section 40 which is connected removably to the main filter housing section 42. The main filter housing section 42 can be opened by removal of the inlet deflection housing section 40. The outlet 34 with the outlet socket 36 is located at an end face of the main filter housing section 42. The inlet deflection housing section 40 is arranged at the opposite end face. An air filter element 44 is arranged in the main filter housing section 42.

The air filter element 44 is designed as a flat-oval annular filter element. A filter axis 46 of the air filter element 44 extends perpendicularly to its cross-section. The filter axis 46 extends horizontally in normal orientation of the truck 100. The air filter element 44 is closed off at an end face that is facing the inlet deflection housing section 40 by means of an end disk 45. The air filter element 44 separates the inlet deflection housing section 40 seal-tightly from the outlet 34. The air filter element 44 can be flowed through for filtration of the combustion air relative to the filter axis 46 in radial direction from the exterior to the interior. It comprises a filter medium, not of interest in this context, that is circumferentially closed. An interior of the air filter element 44 that adjoins an outflow-associated clean side of the filter medium is connected with the outlet 34. A circumferential space 48 which circumferentially surrounds the air filter element 44 is connected with the interior of the inlet deflection housing section 40. The circumferential space 48 adjoins the inflow-associated raw side of the filter medium.

The inlet deflection housing section 40 has at its top side a receptacle 50 for the lower end of the intake pipe part 30. An interior of the rigid intake pipe part 30 is connected with the interior of the inlet deflection housing section 40. The intake pipe part 30 is connected seal-tightly with the receptacle 50.

At a bottom side of the main filter housing section 42 there are two fastening sections 52 with which the intake module 22 is separably attachable to a horizontal section of the bracket 24.

The intake pipe part 30 is approximately circular-cylindrical. Its longitudinal axis extends parallel to the long transverse axis of the air filter element 44 and of the filter housing part 28 and perpendicular to the filter axis 46 of the air filter element 44. In the normal mounted state of the intake module 22 and in normal orientation of the truck 10, the longitudinal axis of the intake pipe part 30 extends vertically.

In the area of the lower end, a baffle collar 54 is coaxially arranged in the interior of the intake pipe part 30. An interior of the baffle collar 54 is open toward the interior of the inlet deflection housing section 40 and toward the interior of the intake pipe part 30, respectively. The baffle collar 54 is surrounded outwardly in radial direction by a circumferentially extending collecting space 56 which is delimited in radial direction outwardly by the radial inner circumferential side of the intake pipe part 30. By means of the baffle collar 54 in a way to be explained in the following, water that is entrained by the sucked-in combustion air can be separated. The baffle collar 54 serves as a separating surface for the water. The collecting space 56 serves for receiving the separated water and/or particles that have been separated from the sucked-in combustion air.

The collecting space 56 is closed at the lower end face of the intake pipe part 30. In the area of the lower end face of the intake pipe part 30, laterally a drainage device comprising a drain socket 58 extends through the circumferential wall of the intake pipe part 32 to the exterior. The drain socket 58 is connected to the collecting space 56. The drain socket 58 extends at a slant downwardly away from the intake pipe part 30. In the area of its free end, the drain socket 58 comprises a drain valve 60. Through the drain socket 58, separated media, e.g. separated water and/or separated particles collected within the collecting space 56, can be drained from the intake module 22 by opening the drain valve 60 correspondingly.

A cyclone separator 62 is arranged upstream of the upper inlet-associated end of the intake pipe part 30. The cyclone separator 62 serves for separating particles possibly entrained in the sucked-in combustion air, for example, dust particles. The cyclone separator 62 comprises a separator pipe part 61 which is arranged coaxially to the intake pipe part 30 and is connected seal-tightly with the latter. The separator pipe part 61 forms an extension of the intake pipe part 30 and can therefore be considered a component of the intake pipe part 30. The cyclone separator 62 moreover comprises a plurality of separator vanes 64 which extend in the separator pipe part 61 in radial direction from the interior to the exterior. The separator pipe part 61 is connected separably, for example, by means of a locking connection, with the intake pipe part 30. The cyclone separator 62 can thus be removed, for example, for servicing purposes or cleaning purposes. Also, the cyclone separator 62 can be arranged optionally in the intake module 22. In this way, the intake module 22, depending on the intended use and/or location of use of the truck 10, can be furnished with a cyclone separator 62.

The upper end of the separator pipe part 61 is inserted seal-tightly into a receptacle 66 of an outlet section 68 of the intake housing part 32. The receptacle 66 is designed such that the intake pipe part 30 can also be inserted directly therein, in case the intake module 22 is realized in an embodiment without cyclone separator 62.

The outlet section 68 comprises a 90 degree bend and extends to an inlet section 70 of the intake housing part 32. The inlet section 70 is located on the side of the longitudinal axis of the intake pipe part 30 which is located opposite the filter housing part 28. The inlet section 70 comprises an inlet opening 72 on its side which is facing away from the outlet section 68. In a view from the inlet opening 72, the inlet section 70 tapers in the direction toward the outlet section 68. As a whole, the inlet section 70 has a flat-oval cross-section. The long transverse axis of its cross-section extends approximately parallel to the long transverse axis of the cross-section of the filter housing 28. In the normal mounted state and normal orientation of the intake module 22, the long transverse axis of the cross-section of the inlet section 70 extends vertically. The long transverse axis of the inlet section 70 is located in a common center plane together with the longitudinal axis of the intake pipe part 30 and the filter axis 46. An upper circumferential side of the inlet section 70 extends horizontally and passes into an upper circumferential side of the outlet section 68. In a view from the inlet opening 72, a lower circumferential side of the inlet section 70 extends initially approximately horizontally. After a bend, the lower circumferential side of the inlet section 70 extends at a slant upwardly to the receptacle 66 of the outlet section 68. The slantedly extending lower circumferential wall forms a funnel-shaped configuration of the inlet section 70.

A plurality of separating surfaces 74 are arranged on the circumferential walls of the inlet section 70 that are vertical and radially inwardly positioned. The separating surfaces 74 extend each approximately horizontally from the inlet opening 72 to the respective sidewalls of the inlet section 70 and of the outlet section 68 which are positioned opposite the inlet opening 72.

A plane in which the inlet opening 72 is positioned extends approximately vertically. The plane of the inlet opening 72 extends perpendicular to the filter axis 46. The inlet opening 72 is covered by an air-permeable inlet grid 76. The inlet grid 76 is connected separably by means of a locking connection to the inlet section 70. The inlet grid 76 is comprised of a water-separating material, for example, of a plastic material.

The inlet grid 76 has an approximately sawtooth-like profile. The tooth tip lines 78 of the saw tooth-like profile at the inflow-associated exterior side of the inlet grid 76 extend, as is shown in particular in FIG. 2, at a slant from top to bottom.

Tooth backs 80 of the saw tooth-like profile are located at the top. The tooth backs 80 are continuously closed and extend each from the side which is facing the interior of the inlet section 70 at a slant from the top to the bottom toward the outer inflow side of the inlet section 70. Accordingly, precipitation, for example, rain or snow, which generally is coming in at a slant from above, can be caught at the tooth backs 80 and can be deflected outwardly and downwardly. In this way, the precipitation does not directly enter the interior of the inlet section 70.

Tooth fronts 82 of the sawtooth-like profile are located at the bottom. The tooth fronts 82 extend in a first expansion direction perpendicular to the tooth tip lines 78 toward the tooth bases of the sawtooth-like profile approximately parallel to the filter axis 46, i.e., horizontally in the normal mounted state of the intake module. In a second expansion direction, which is perpendicular to the first expansion direction, the tooth fronts 82 extend, in accordance with the tooth backs 80, at a slant between the oppositely positioned vertical circumferential walls of the inlet section 70. The tooth fronts 82 each have a plurality of inlet holes 84 through which the combustion air from the environment can pass into the inlet section 70.

As a whole, the intake housing part 30 is arranged, displaced at a slant, above the filter housing part 28 and is connected therewith by means of the intake pipe part 30. In this way, an intake location for the sucked-in combustion air which is defined by the inlet opening 72 can be arranged as far upwardly as possible. Here, loading of the ambient air with particles and water is generally lower compared to near the road surface.

Figure 5:
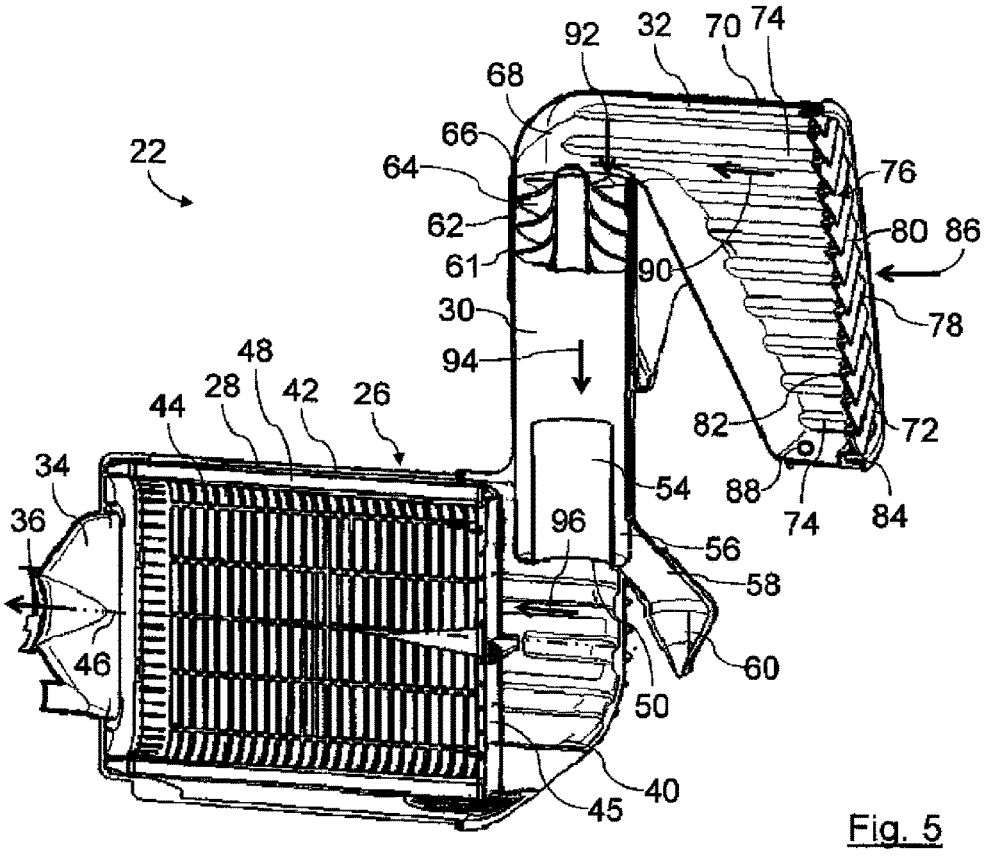
FIG. 5 shows a longitudinal section of the intake module of FIGS. 1 to 4.

Upon operation of the internal combustion engine, the ambient air, indicated in FIG. 5 by an arrow 86, is sucked in through the inlet holes 84 of the inlet grid 76 into the interior of the inlet section 70. The ambient air may entrain particles and/or moisture. With the tooth backs 80 and as a result of the water-separating material properties of the inlet grid 76, possibly occurring precipitation or water that in other ways reaches the area of the inlet opening 72 is retained. In the interior of the inlet section 78 the sucked-in combustion air is guided across the separating surfaces 74 where water still entrained by the combustion air is separated. The water that is separated thereat reaches the bottom as a result of the force of gravity. At the bottom side of the inlet section 70 a water outlet 88, illustrated in FIG. 5, is provided through which the separated water can drain into the environment.

In the inlet section 78 that is tapering in a funnel shape, the combustion air is guided to the outlet section 68. In doing so, the flow velocity in the air stream is increased. A main flow direction of the combustion air into the inlet section 70 immediately upstream of the outlet section 68 is indicated by arrow 90.

In the outlet section 68, the main flow direction of the internal combustion air is deflected downwardly by approximately 90 degrees. The combustion air is supplied to an inlet side of the cyclone separator 62. The main flow direction at the inlet side of the cyclone separator 62 is indicated in FIG. 5 by an arrows 92. At the separator vanes 64, particles possibly contained in the combustion air, for example, dust particles, are separated. As a result of centrifugal force in radial outward direction, the dust particles reach the radial inner circumferential wall of the separator pipe part 61. They sink, following the force of gravity, along the radial inner circumferential wall of the separator pipe part 61 and of the intake pipe part 30 in downward direction and reach the collecting space 56.

A main flow direction of the combustion air in the intake pipe part 30 is indicated in FIG. 5 by an arrow 94. The combustion air reaches the area of the baffle collar 54. The combustion air flows into the interior of the baffle collar 54. Water that is possibly still contained in the combustion air is "peeled off" by the baffle collar 54 from the main stream of the combustion air and is collected in the collecting space 56.

The combustion air from which the water has been separated as much as possible passes from the intake pipe part 30 into the inlet deflection housing section 40 of the filter housing part 28. Here, the main flow direction of the combustion air is again deflected by approximately 90° relative to the air filter element 44. The main flow direction in the inlet deflection housing section 40 is indicated by an arrow 96.

As a whole, the main flow path of the combustion air in the intake module 22 extends thus approximately Z-shaped. The main flow directions 90, 92, 94, and 96 and the main flow path relate to the average flow directions of the combustion air. In this context, possible turbulences or transverse flows are neglected for reasons of simplicity.

The combustion air is distributed in the inlet deflection housing section 40 and reaches the circumferential space 48. The combustion air to be filtered flows through the filter medium of the air filter element 44 in radial direction from the exterior to the interior and is filtered. The filtered combustion air passes from the interior of the filter element 44 to the outlet 34 of the filter housing part 28 and from there through the outlet socket 36 into the connecting hose 38. With the latter, the combustion air that has been substantially freed from water and particles and has been filtered is supplied to the internal combustion engine for combustion.

As needed, the drain valve 60 is opened and water collected within the collecting space 56 and particles contained therein are drained from the collecting space 56. In the collecting space 56, a water level sensor can be arranged which, for example, transmits a corresponding water level signal to an appropriate control unit and, based thereon, the drain valve 60 can be opened. Alternatively, the drain valve 60 can be opened, for example, in predetermined time intervals or intervals that depend on the operating duration or other operating parameters.

In the afore described embodiment of an intake module 22, inter alia the following modifications are possible:

The invention is not limited to an intake module 22 of an internal combustion engine of a truck. Instead, it can also be employed in other types of automobiles, for example, buses, tractors or other commercial vehicles. It can also be used in other types of motorized vehicles, for example, watercraft.

The filter housing part 28, the intake pipe part 30, and/or the intake housing part 32 can be made, instead of being made of plastic material, also at least partially of another type of material, for example, a carbon fiber-containing material.

The filter housing part 28, the intake pipe part 30, and/or the intake housing part 32, instead of being produced by a blow-molding method, can also be produced by another method, for example, according to an injection-molding method.

At least some of the housing parts 28, 30, 32 of the module housing 26 can also be connected monolithically with each other.

While specific embodiments of the invention have been shown and described in detail to illustrate the inventive principles, it will be understood that the invention may be embodied otherwise without departing from such principles.

What is claimed is:

1. An intake module of an air intake tract of an internal combustion engine of a motor vehicle, the intake module comprising:

an intake housing part comprising an inlet section and an outlet section;

at least one inlet opening for combustion air to be filtered to enter the inlet section of the intake housing part;

an inlet grid arranged in the at least one inlet opening of the intake housing part;

wherein the outlet section is arranged at an opposite second end of the intake housing part relative to the inlet section;

a plurality of water separating surfaces formed on circumferential housing walls of the intake housing part, the plurality of water separating surfaces each elongated horizontally in a direction from the inlet grid to the outlet section of the intake housing part, the plurality of water separating surfaces extending parallel to each other, the plurality of water separating surfaces each having a first end positioned at the inlet grid, and terminating at the opposite second end of the inlet section of the intake housing part;

the plurality of water separating surfaces providing an enlarged surface area that is active for water separation;

and a water drain outlet opening arranged in a bottom wall of the intake housing part below the plurality of water separating surfaces;

a filter housing part comprising an air filter element configured to filtrate the combustion air, the filter housing part further comprising an inlet section and further comprising at least one outlet for the filtered combustion air;

an air connection disposed between the outlet section of the intake housing part and an inflow side of the air filter element;

a fixed intake pipe part arranged between the outlet section of the intake housing part and the inlet section of the filter housing part, wherein the fixed intake pipe part at least partially forms the air connection between the outlet section of the intake housing part and the inflow side of the air filter element.

2. The intake module according to claim 1, wherein the filter housing part and the intake housing part are arranged so as to be displaced relative to each other.

3. The intake module according to claim 1, wherein a flow cross-section provided in the intake housing part decreases in a main flow direction of the combustion air.

4. The intake module according to claim 1, further comprising at least one water separating device arranged upstream of the inflow side of the air filter element.

5. The intake module according to claim 1, further comprising at least one water separating surface arranged in the intake housing part.

6. The intake module according to claim 1, further comprising at least one water separating surface arranged in the intake pipe part.

7. The intake module according to claim 1, further comprising at least one particle separating device arranged fluidically between the at least one inlet of the intake housing part and the inflow side of the air filter element.

8. The intake module according to claim 1, further comprising at least one drainage device configured to drain media separated from the combustion air, wherein the at least one drainage device is arranged between the inlet of the intake housing part and the inflow side of the air filter element.

9. The intake module according to claim 1, wherein the filter housing part and the intake housing part are flat.

10. The intake module according to claim 1, wherein the filter housing part is flat.

11. The intake module according to claim 1, wherein the intake housing part is flat.

* * * * *